US005964634A

United States Patent [19]

Chang

[11] Patent Number: 5,964,634

[45] Date of Patent: Oct. 12, 1999

[54] SOFT BRICK MODULAR BUILDING CONSTRUCTION SET

[76] Inventor: James Chang, 1612 Ricky Rd., Charlottesville, Va. 22901

[21] Appl. No.: 08/942,798

[22] Filed: Oct. 2, 1997

Related U.S. Application Data

[60] Provisional application No. 60/027,432, Oct. 2, 1996.

[51] Int. Cl.[6] ..... A63H 33/04

[52] U.S. Cl. ..... 446/85; 446/111; 446/901

[58] Field of Search ..... 434/150, 236, 434/403; 273/260; 446/85, 100, 108, 111, 112, 901; 52/DIG. 13; 297/DIG. 6

[56] References Cited

U.S. PATENT DOCUMENTS

| | | | |
|---|---|---|---|
| 1,620,574 | 3/1927 | Savage | 446/85 |
| 2,976,914 | 3/1961 | Miller | 297/423.15 |
| 4,028,855 | 6/1977 | Prewer | 52/272 |
| 4,635,418 | 1/1987 | Hobgood | 52/239 |
| 4,722,712 | 2/1988 | McKenna | 446/92 |
| 4,978,301 | 12/1990 | Dodge | 434/96 |
| 5,007,676 | 4/1991 | Lien | 297/228.13 |
| 5,330,379 | 7/1994 | Roh et al. | 446/71 |
| 5,348,510 | 9/1994 | DuPont et al. | 446/100 |

FOREIGN PATENT DOCUMENTS

| | | | |
|---|---|---|---|
| 1300206 | 6/1962 | France | 446/901 |
| 2082925 | 3/1982 | United Kingdom | 446/901 |

*Primary Examiner*—Robert A. Hafer
*Assistant Examiner*—Michael B. Priddy
*Attorney, Agent, or Firm*—Eugene E. Renz, Jr., PC

[57] ABSTRACT

A kit for building objects from block-like construction pieces comprising a plurality of construction pieces, each having a core made of resilient flexible foam material and having a plurality of planar faces, an outer cover snugly fitting over and completely covering the outer peripheral surface of the foam core made of a looped fabric and a plurality of double-sided hooked surface tabs for lockingly engaging with the loop fabric so that the construction pieces may be releasably assembled to one another and reinforcing strips adapted to be removably connected to tabs for bridging adjacent blocks.

20 Claims, 3 Drawing Sheets

SOFT BRICK MODULAR BUILDING CONSTRUCTION SET

This application claims the benefit of U.S. Provisional Application No. 60/027,432 filed Oct. 2, 1996.

FIELD OF THE INVENTION

The present invention relates to building construction pieces of varying sizes, colors, and geometrical shapes, which can be releasably joined to one another in an unlimited number of ways through the use of double-sided hook tabs and display loop fabric to form varied and interesting structures. The present invention enables users such as young children to create an unlimited number of practical and whimsical structures such as furniture, make-believe animals, and play houses for educational and entertainment purposes. The invention may also be used by others, such as by retail merchants to display products.

BACKGROUND OF THE INVENTION

Description of the Prior Art

The use of toy building blocks is known in the prior art. A patent to Brooks U.S. Pat. No. 5,458,522 shows toy building blocks for constructing toy buildings and the like and sets forth the history of the building block prior art.

Construction sets of all kinds have been developed in the prior art. Some of these kits have consisted of components which could be easily connected to one another to form larger structures, and can be disconnected. The present invention relies upon a significant modification of the hook-and-loop fastening system to provide greater adhesive strength, structured stability, ease of use, and interchangeability among construction pieces.

In the prior art, when the traditional hook-and-loop fastening system is employed to join modular construction pieces or accessories together, the hook-surfaced and loop-surfaced materials are, out of necessity, permanently affixed to the objects to be joined. See for example the prior art patents as listed:

U.S. Pat. No. : 5,458,522 Title: FABRIC FASTENER BUILDING BLOCK
Inventor: James A. Brooks, VIII
Issued Date: Oct. 17, 1995
U.S. Pat. No. 4,710,145
Title: THERAPEUTIC DOLL FIGURE
Inventor: Nancy Hall Vandis
Issued Date: Dec. 1, 1987
U.S. Pat. No. 5,458,522
Title: FABRIC FASTENER BUILDING BLOCK
Inventor: James A. Brooks, III
Issued Date: Oct. 17, 1995
U.S. Pat. No. 5,348,510
Title: TOY WITH FANCIFUL INTRA-CHANGEABLE PARTS
Inventor: Paul DuPont et al.
Issued Date: Sep. 20, 1994
U.S. Pat. No. 5,322,465
Title: HAND PUPPET KIT
Inventor: David P. McGill
Issued Date: Jun. 21, 1994
U.S. Pat. No. 4,762,494
Title: PSYCHOTHERAPY DEVICE
Inventor: Ruth E. Woods
Issued Date: Aug. 9, 1988
U.S. Pat. No. 4,504,240
Title: HAND PUPPET WITH DETACHABLE FACIAL ELEMENTS
Inventor: John J. Thomas
Issued Date: Mar. 12, 1985
U.S. Pat. No. 4,722,712
Title: GEOMETRIC TOY
Inventor: Katharine L. McKenna
Issued Date: Feb. 2, 1988
U.S. Pat. No. 4,937,181

Title: EDUCATIONAL DISPLAY SYSTEM

Inventor: John Rogers

Issued Date: Jun. 26, 1990

U.S. Pat. No. 4,722,712

Title: GEOMETRIC TOY

Inventor: Katharine L. McKenna

Issued Date: Feb. 2, 1988

U.S. Pat. No. 4,964,832

Title: MODULAR PUPPET SYSTEM

Inventor: Charles Bickoff

Issued Date: Oct. 23, 1990

U.S. patent application Ser. No.: 4,699,385

Title: CHESS PUZZLE BOARD AND PIECES

Inventor: Bifulco

Issued Date: Oct. 13, 1997

These patents show systems wherein the hook and loop material is permanently affixed to blocks or other modular pieces to releasably join the modular pieces together. Consequently, the user of the construction pieces has no discretion over where on the construction pieces to place the hook-surfaced and loop-surfaced fastening materials. Moreover, because the traditional hook and loop-surfaced materials are costly and unpleasant to the touch, manufacturers have limited the amount of hook-surfaced and loop-surfaced material affixed to the construction pieces or other objects to be joined. Manufacturers have placed the hook-surfaced and loop-surfaced materials only where it was guessed that connection between construction pieces was most likely to occur. Unfortunately, where there is no hook and loop material, the construction pieces cannot be joined together; the construction pieces can only be joined together where the fastening material is. Consequently, the number of possible construction piece configurations is limited.

The problem has been aggravated by the fact that the tabs and strips of fastening material must be located on the construction pieces such that when the two construction pieces are placed face to face, the tabs and strips of adhesive material must be of opposite types, one-hook-surfaces and one loop-surfaced. This requirement poses a problem because even if the manufacturer affixes the tabs or strips at the most likely points of attachment on the surfaces of the construction pieces, the manufacturer still must make an educated guess about which material to use where for the greatest number of successful matches between hook-surfaced or loop-surfaced tabs or strips. For the user, it can become frustrating to try to match up the hook-and loop materials when trying to join the construction pieces together.

To a limited extent, this particular problem can be mitigated by insuring that each construction piece has a combination of both hook-surfaced and loop-surfaced material at every likely point of contact such that at any place where two construction pieces touched, some hook-surfaced fabric would contact some loop-surfaced fabric. However, when this method has been used, the tabs and strips have taken on a checkerboard appearance, which is aesthetically not pleasing.

Another limitation is that because the tabs and strips or hook-surfaced and loop-surfaced material cannot be added to or removed from the construction pieces at the discretion of the user, the user cannot control the adhesive force between the construction pieces by varying the amount of hook-surfaced and loop surfaced material connecting the construction pieces together.

Another problem with permanently affixing the tabs or strips of hook and loop material to the construction pieces is that inevitably some of those tabs or strips are exposed to view on the finished structure, and they cannot be removed. Such exposed tabs or strips detract from the overall appearance of the structure formed. In addition, because the hook-surfaced material is somewhat stiff and unpleasant to the touch, permanently affixing the hook-surfaced and loop-surfaced material to the construction pieces causes the surfaces of the individual construction pieces and the finished structure to be unpleasant to the touch.

The present invention solves the above problems through the employment of double-sided hook-surfaced tabs in combination with geometrically-shaped, planar-faced construction pieces to form a superior building construction system.

Bickoff, U.S. Pat. No. 4,964,832, issued Oct. 23, 1990, shows puppets wherein body part extremities, facial features, accessories such as clothing are attached by hook and loop materials to primary body and head parts to form a "stuffed toy", doll, puppet, or marionette.

SUMMARY OF THE INVENTION

The present invention essentially comprises a construction piece of any geometrical shape with planar faces having fabric fasteners secured thereto for releasably coupling the piece to another piece. Each construction piece may be hollow or solid, such as consisting of foam material. The construction piece of the present invention is covered at least partially with display loop fabric and is accompanied by independent double-sided hook-surfaced tabs which may be removably affixed to said fabric so as to permit the attachment of one construction piece to another. In an alternate embodiment of the present invention a reinforcement strip is connected to each of said construction pieces by double-sided hook-surfaced tabs wherein, at least one side of the reinforcement strip is covered with display loop fabric.

The present invention relates to a novel device comprising relatively large, light-weight, soft building blocks of a variety of shapes, and various fastening devices which are also of a relatively large size, where both the blocks and the fastening devices are appropriate for use by small children and infants as well as other age groups, for a variety of purposes. More specifically, primarily the blocks are preferably of a size that permits and invites users to either sit upon, stand on, lie upon, jump on, or be supported by the blocks, or which contribute structurally to the building of structures which permit and invite such above use, or which contribute structurally to the building of structures which permit the user to pass through such a structure or sit under the structure. The blocks are also primarily of a size that encourages not only fine motor skills, but also gross motor skills in the course of manipulating or arranging one or more blocks. Blocks that encourage gross motor skills have many benefits educationally, developmentally, recreationally, and also therapeutically; in addition to the standard uses of a construction set, it is envisioned that the blocks may be used by physical and occupational therapists to rehabilitate patients through the encouragement of gross motor activities in the manipulation one or more blocks. It is envisioned that some of the block dimensions will allow the blocks to be used as protective pads, such as on floors or sharp-corned furniture to guard children from injury. The tabs and strips are oversized to prevent ingesting and may have rounded edged to eliminate sharp corners which present a risk of injury. As explained, the blocks are constructed for durability and can be easily disassembled to wash or clean the outer cover. The blocks are preferably polygonal, flat surfaced elements which makes it easy for even toddlers to place double-sided hook tabs on the flat surfaces which have a large area and this facilitates assembly of large blocks to one another. Older children can place tabs more selectively across the juncture of blocks to make a more secure connection.

Each block is sized and proportioned to be highly versatile, providing the user with a great degree of discretion over the way in which each block can be arranged in relation to other blocks. To permit such versatility, the blocks are preferably within a particular range of dimensions. The blocks are also sized and proportioned keeping in mind the practical issues of storage by the user and manufacturing cost. Preferably, the blocks have a minimum surface and are dimensioned proportionately to each other to compatibly fit together in assemblies created from the blocks. For example, the width of the cube-type block is an even multiple widthwise relative to a flat elongated block so that three cubes can be fitted on the longest flat surface of the flat elongated block.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENT

Figure 5:
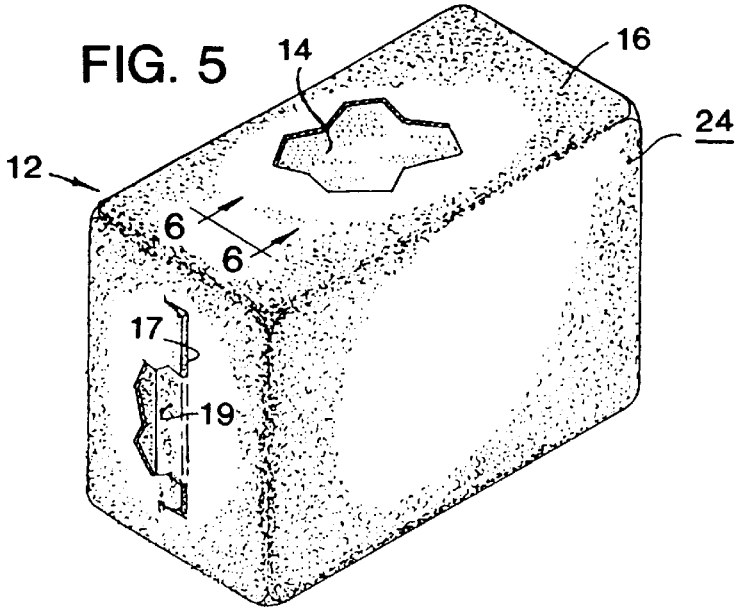
FIG. 5 is an enlarged fragmentary isometric view of the rectangular soft block shown in FIG. 1 of the drawings with portions of the drawing broken away and in section to show details of construction.
Figure 6A:
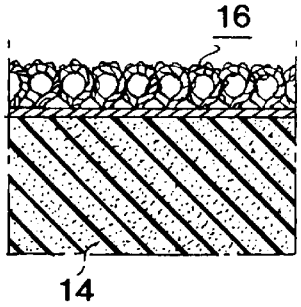
FIG. 6A is an enlarged fragmentary schematic sectional view taken on the line 6A, 6A of FIG. 5 showing the foam core having a looped fabric sheath.
Figure 11:
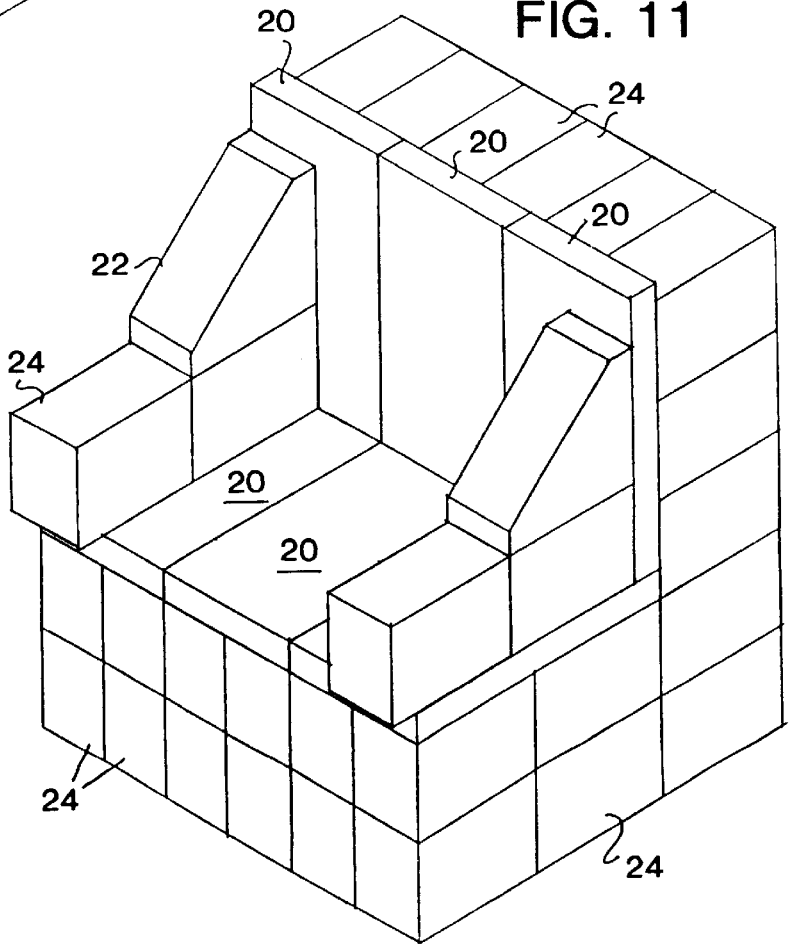
FIG. 11 is an isometric view schematically showing a structure created from the three soft block building components and double-sided hooked tabs shown in FIG. 1 the structure shown could be an arm chair or a building.

Referring now to the drawings and particularly to FIG. 11 thereof, there is shown a toy structure 10 constructed with the soft block construction pieces 12 of the present invention. With reference to FIG. 5 of the drawings, each construction piece 12 essentially consists of a foam core 14 and an outer cover 16 of a material to form a bond with hook-surfaced material. The outer cover is, preferably made of display loop fabric. The fabric 16 as illustrated in FIG. 6A comprises a backing material 17 and a dense population of loops L projecting from one face of the backing B. As a fabric, it is usually soft to the touch, may come in wide swaths, is attractive, and may be worked like any other fabric. Display loop fabric is often used for display boards, hence the name. Display loop fabric has many textures, including but not limited to that of velvet or felt, burlap, or office carpet. The construction pieces 12 or blocks are preferably polygonal and have flat planar faces F. The embodiments illustrated comprise a three-dimensional slab-shaped, rectangular solid 20, a five-sided wedge shape 22 or an essentially six-sided block shape 24, with each significant face F being a flat plane rather than curved. The outer covering 16 of each construction piece 12 can be permanently affixed to the core (see FIG. 6C), or can be made removable by a slit 17 and flap 19 as shown in FIG. 5. The outer covering 16 can be of a fabric separately manufactured and then placed over the core 14, or it can be applied directly onto the core 14 as part of the manufacturing process without being separately fabricated. The outer covering 16 can be affixed to the core 14 by a variety of methods, such as by sewing the outer covering so it can be pulled over the core, or by gluing or laminating the covering onto the core. When the outer covering is to be pulled over the core, the core may first be covered with a thin flexible plastic sheath 30 or its functional equivalent to allow the outer covering to slip over the core 14 more easily (see FIG. 6B). The core may also contain or consist of a structural support mechanism such as one or more springs or air-filled bladders or chambers.

For the present invention, the construction pieces 12 are covered partially or entirely by this display loop fabric 16 or its functional equivalent. These construction pieces 12 are joined together through the employment of double-sided hook-surfaced tabs 40 which are independent of the construction pieces 12 rather than being permanently affixed, and which may be of varying lengths and widths. All potentially connecting faces F of these construction pieces 12 are flat-surfaced (on a single plane) rather than curved, to permit maximum contact area between the faces of the construction pieces 12 to be joined.

Figure 8:
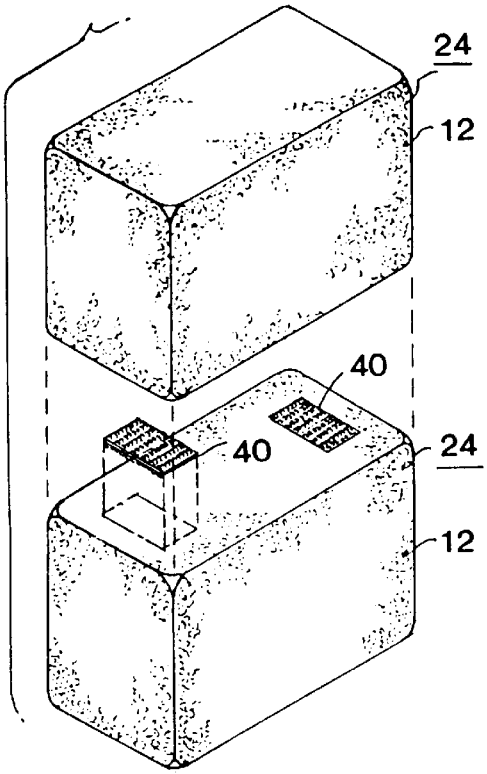
FIG. 8 is an exploded isometric view illustrating how two soft blocks may be joined together by the use of the double-sided hook-surfaced tabs.
Figure 9:
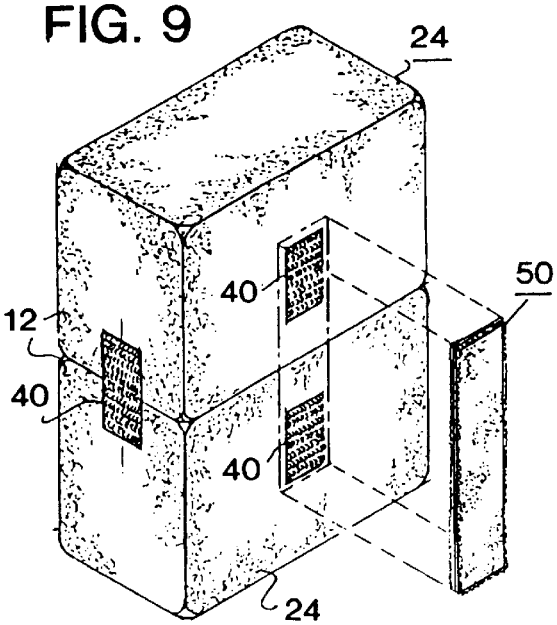
FIG. 9 is an isometric view of two soft blocks joined together as shown in FIG. 8 and then juncture reinforced by the application of a double-sided reinforcement strip and by a double-sided hook-surface tabs.
Figure 10:
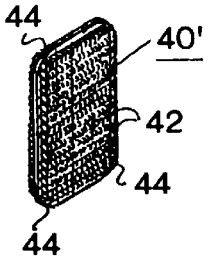
FIG. 10 is an isometric view of a slightly modified double-sided hooked tab having rounded edges to eliminate sharp corners.

The tabs 40 are unique in two ways. First, instead of having the myriad tiny hooks 42 on only one side, the tabs 40 are double-sided, having these tiny hooks 40 on both sides. Second, with reference to FIGS. 1, 2 and 8 instead of being permanently affixed to the object to be attached, these tabs 40 are independent of the construction pieces 12, removably placed in between construction pieces 12 at those location on each piece where the user desires the construction pieces 12 to be joined with reference to FIG. 9. The tabs 40 can be manufactured into longer strips so that instead of going in between construction pieces 12, the tabs 40 can be placed on the outward adjacent faces of two adjacent construction pieces 12, which may be easier for younger children to do, and can at times be a more practical and stronger method of connection. Also, a modified tab 40' shown in FIG. 10 of the drawings has rounded corners 44 to prevent a possible injury due to a pointed edge. Used in this fashion, it is not necessary that the tabs be double-sided but instead may have hooks in only one side, and may have loop-surfaced material on the opposite side.

Figure 1:
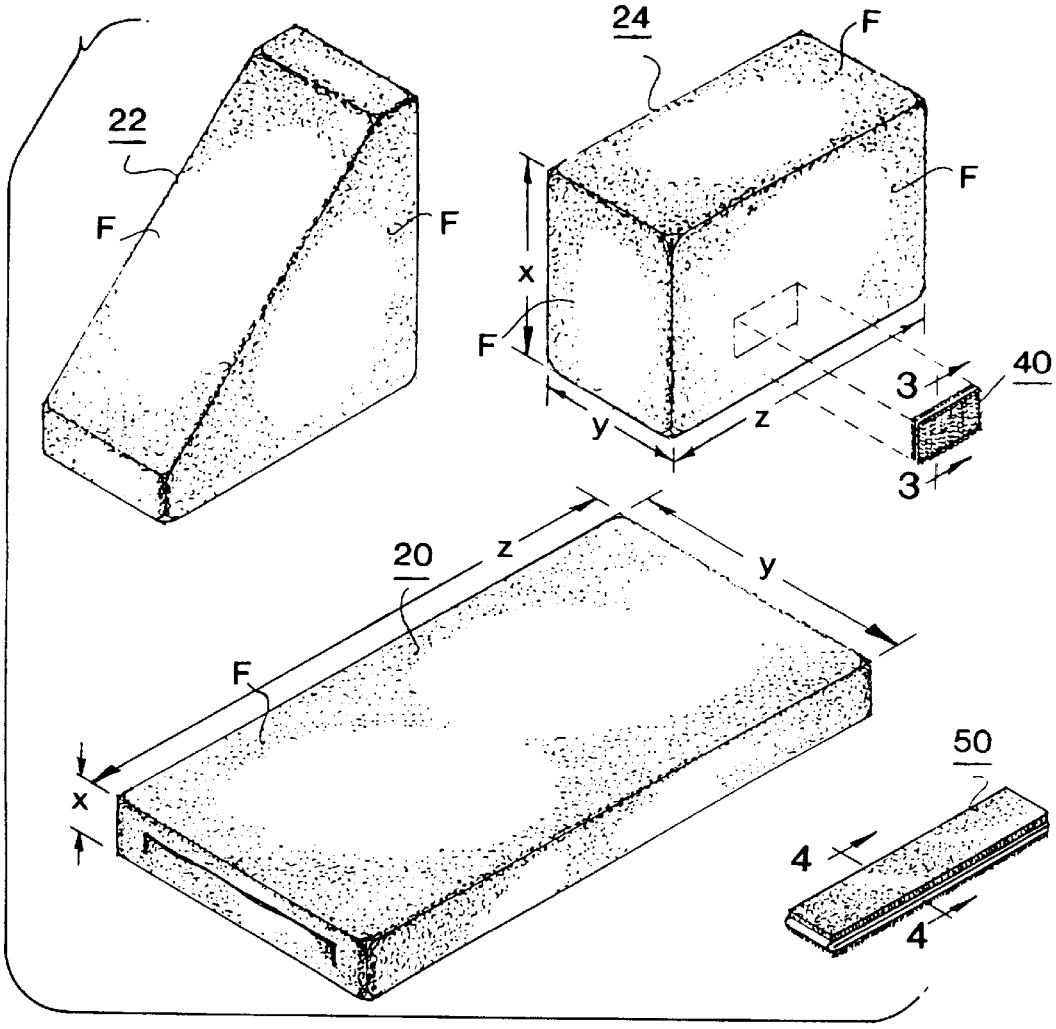
FIG. 1 is an isometric view of three soft block building components incorporating the construction pieces of the present invention also shown is a double-sided hooked surface tab for selectively joining the soft blocks together and a double-sided looped fabric reinforcing strip.
Figure 2:
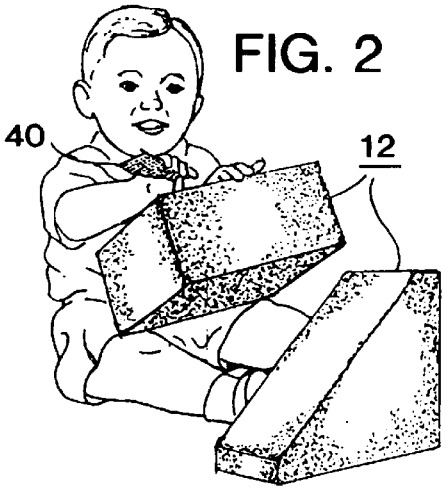
FIG. 2 is a perspective view showing a small child holding a very light soft block of some size, engaged in applying a double-sided hooked surface tab to the soft block in hand prior to maybe connecting the triangular soft block to the rectangular soft block.
Figure 3:
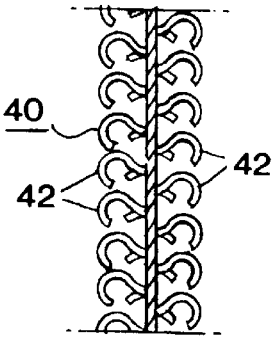
FIG. 3 is a greatly enlarged fragmentary sectional view taken on lines 3,3 of FIG. 1 schematically the construction of a double-sided hooked soft block connecting tab.
Figure 4:
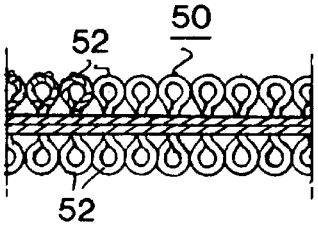
FIG. 4 is a greatly enlarged fragmentary sectional view taken on the line 4,4 of FIG. 1 showing schematically the construction of a double-sided looped soft block reinforcing strip.

To strengthen the adherence between construction pieces, reinforcement strips 50 may be used with reference to FIGS. 1 and 4. These reinforcement strips 50 are flat strips of material consisting of two strips of display loop fabric fused or joined back to back, through such means as sewing resulting in double-sided display loop fabric strips 16, or a strip of fabric in which one side is covered with display loop fabric 16 and the other side is covered with some other fabric. Preferably, the reinforcement strips 50 are approximately 2 inches wide and 4 to 8 inches long, but may be longer. They are employed by attaching one end of the reinforcement strip 50 to a construction piece 12, and then attaching the other end of the strip 50, on the same side of the strip, to another construction piece 12, through the use of double-sided hook tabs 40. The lateral friction (shear friction) between the construction pieces 12, the double-sided hook tabs 40, and the reinforcement strips 50, results in a greatly enhanced adherence between the construction pieces 12 themselves.

The advantages of the building construction system of the present invention are manifold. The system is simple and easy to use because it allows for the placement of tabs wherever needed resulting in an infinite variety or configurations and consequently, even young children can use the system. The user can vary the adhesive force between the construction pieces 12 as needed by varying the number of double-sided tabs 40. Exposed surfaces F of the construction pieces 12 do not have affixed to them unsightly and rough-surfaced tabs or strips of adhesive material since the double-sided tabs can be removed when not in use, allowing for an attractive and pleasantly soft surface. There is no need for the manufacturer to make an educated guess as to the best placement of hook-surface material since the tabs are not permanently affixed but instead is applied, removed, and reapplied at discretion of the user. This is a more cost effective use of hook-surfaced material since the materials is only used where needed.

The construction pieces in the present invention have flat, planar faces such that when two construction pieces are placed together, any two faces placed side-by-side will be very close together or touching, and their edges will be linear, allowing for a maximum number of locations where hook-surface tabs 40 can be placed on the adjacent faces F or edges of the construction pieces.

Accessories such as a steering wheel for a make-believe car, a burner element for a make-believe stove, or letters of the alphabet for a sign-board, may be attached to the construction pieces, either by means of hook-surfaced material permanently affixed to the accessories, by use of the double-sided tabs, or without the use of any hook-surfaced material whatsoever, as in the application of letters of the alphabet made out of felt material. When the soft core 14 of the construction pieces 12 is made from a soft depressible material it provides a comfortable sitting or lying arrangement.

Preferably, when the construction piece has five faces F, all of the sides are even, flat and level (on a single plane, as opposed to convex, concave or curved). Preferably, when the construction piece has six or more faces, at least six of the faces are substantially even, flat and level.

Preferably, the core 14 is made of polyurethane foam or similarly soft, depressible material and is surrounded substantially or completely by an outer covering 16 comprising preferably material known in the fastener industry as display loop. For each and every construction piece's face which is primarily meant to have significant contact with other construction pieces, preferably at least 20% of the outer covering's surface is comprised of display loop fabric or a functionally equivalent material, in any configurations which are convenient for manufacture and cost effective.

In the case of wedge-shaped construction pieces, preferably loop-surfaced fabric or material or its functional equivalent is affixed preferably to five sides of the construction piece or of the outer covering. In the case of construction pieces with six or more sides, loop-surfaced fabric or material or its functional equivalent is affixed preferably to six or more sides of the construction piece or to six or more sides of the outer covering.

The outer covering of each construction piece can be designed to be affixed permanently to the core or can be designed to be removable from the core for such purposes as cleaning in a clothes washer.

Between the core 14 and the outer 16 covering it may be preferable to place a thin, flexible plastic sheath 30 to allow the outer covering to slip over the core more easily. (See FIGS. 6B and 7.)

When the outer covering fills out, preferably it results in the same dimensions as the construction piece above, and results in the same limitations on placement of loop-surfaced material on the number of faces and characteristics of faces.

Double-side Hook Tabs

The hook tabs are simply flat tabs that have hook surfaces on both sides (double-sided), which are preferably formed by permanently fusing or joining two pieces of hook-surfaced material in a back-to-back configuration, or by manufacturing a single piece of double-sided hook-surfaced material. The tabs may be of varying lengths and widths but are preferably about ≧1.25 inches wide and ≧2 inches long. The tabs may preferably be made with rounded corners instead of sharp, 90 degree angled corners, or be made from a soft cloth-like material.

Reinforcement Strips

The reinforcement strips are flat strips of material consisting of two strips of display loop fabric fused or joined back to back, through such means as sewing, resulting in double-sided display loop fabric strips. Preferably, the reinforcement strips are approximately 2 inches wide and 4 to 8 inches long, but may be longer. The reinforcement strips may also be made to have only one side composed of display loop fabric, with the other side made of some other material.

It is to be understood that the present invention is not limited in its application to the details of construction and to the arrangement of the components set forth in the following description or illustrated in the drawings. Those skilled in the art will appreciate that the conception upon which this disclosure is based my readily be utilized as a basis for designing of their structures, methods and systems for carrying out the several purposes of the present invention. Therefore the following claims are to be regarded as including such equivalent constructions insofar as they do not depart from the sprit and scope of the present invention.

It is to be understood that the present invention is not limited in its application to the details of construction and to the arrangement of the components set forth in the following description or illustrated in the drawings. Those skilled in the art will appreciate that the conception upon which this disclosure is based may readily be utilized as a basis for designing of their structures, methods and systems for carrying out the several purposes of the present invention. Therefore the following claims are to be regarded as including such equivalent constructions insofar as they do not depart from the sprit and scope of the present invention.

Figure 6B:
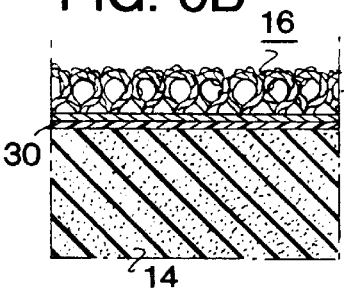
FIG. 6B is a view similar to FIG. 6A but showing the foam core encased in a plastic cover and the foam core and plastic cover encased in a looped fabric sheath.
Figure 7:
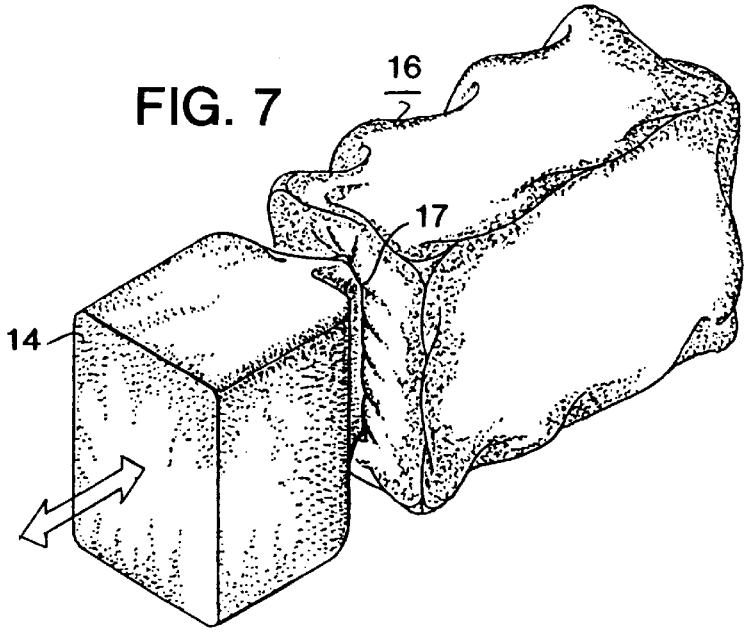
FIG. 7 is an enlarged isometric view showing how the foam core of the soft block may be both removed from its outer fabric sheath in order to wash the outer fabric cover or reinserted in the fabric sheath when cleaned.

In accordance with another embodiment of the present invention shown in FIG. 6B, a plastic sheet 30 or functionally-equivalent material sheathing surrounds the foam core 14 and closely embraces the same to facilitate assembly into the outer cover 16. It also facilitates quick and easy removal of the core 14 element when the cover 16 requires washing or cleaning. The protective waterproof sheathing 30 between the foam core 14 and the outside cover 16 prevents the entry of infectious germs and diseases into the foam core 17. The plastic sheathing 30 may have one or more openings an opening to allow the passage of air from the foam core 14 to the surrounding environment and from the surrounding environment back into the foam core 14.

Figure 6C:
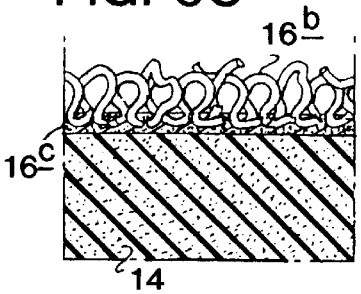
FIG. 6C is a fragmentary section view similar to FIGS. 6A and 6B but showing a modification in that the foam care is covered by flocked short looped fabric pieces cemented to the foam core.

A modification in accordance with the present invention is shown in FIG. 6C. The block assembly includes a core 14 made of foam material and a loop fabric ends 16B bonded directly to the other peripheral surface of the foam core 14 by a suitable bonding cement such as an epoxy 16C.

In accordance with the present invention, the construction piece may have embodied therein means for playing music or generating sound such as police siren or animal sounds. Further, the construction pieces may have means for emitting light.

As discussed previously, the present invention provides large, light weight, soft building blocks appropriate for infants and young children as well as all other age groups which can be assembled easily to produce large assemblies such as a chair shown in the drawing which can accommodate a child. It has been found that when the blocks are within given parameters, they provide optimum play value and greater use, versatility and flexibility. For example, for the rectangular slab-shaped block element Bs with the height or X dimension of the construction piece shown in FIG. 1 is preferably greater than 1.25 inches and less than 3 inches. The length and width designated by the letters "Z" and "Y" respectively, are preferably in the range as follows:

$Y \times Z$ is at least about 81 square inches $Y \times Z \leqq$ about 1440 square inches.

For the construction piece or building block Br shown in FIG. 5, the X, Y and Z dimensions are preferably in the relationship as follows:

X is equal to or greater than 4 inches

Y is approximately equal to or greater than X

Y is approximately equal to or less than 2X

The product of X×Y×Z is equal to or less than approximately 2744 cubic inches, and the product of X×Y×Z is equal to or greater than approximately 126 cubic inches. These volumetric relationships apply for other polygon-shaped blocks.

The cube building block Bt is preferably equal to or less than approximately 2744 cubic inches and equal to or greater than approximately 125 cubic inches.

In the preferred form of construction piece which has been described as a cube shown in FIG. 5, the Z dimension is preferably greater than the Y dimension or Y is preferably greater than X.

Even though particular embodiments of the present invention have been illustrated and described herein, it is not intended to limit the invention and changes and modifications may be made therein within the scope of the following claims. For example, the construction pieces may be used in association with a platform or base having wheels where the platform or base has a flat planar surface to which the planar hook surface or loop surface material which allows constructions pieces to be readily affixed to the platform or base to form a chassis of a truck or automobile. The wheeled platform or base may include a steering mechanism so that in effect the platform serves generally as a base for miniature scale play vehicles. Further, the platform assembly may include a wind-up electric or other motor or engine for purposes of provide the power of a locomotion. The motor or engine may be housed in the block itself.

What is claimed is:

1. A kit for building structures from block-like construction pieces comprising a plurality of construction pieces, each piece having a core made of resilient flexible foam material and having a plurality of planar faces, an outer cover snugly fitting over and completely covering the outer peripheral surface of the foam core made of a looped fabric and a plurality of double-sided hooked surface tabs for lockingly engaging with the loop fabric so that the construction pieces may be releasably assembled to one another.

2. A kit as claimed in claim 1 including flat reinforcing strips comprising two strips of display-looped fabric joined back to back adapted to bridge construction pieces by adhering a reinforcing strip to double-sided hook tabs secured to the outer cover of adjacent construction pieces.

3. A kit as claimed in claim 2 wherein the reinforcement strips are approximately two inches wide and four to eight inches long.

4. A kit as claimed in claim 1 wherein at least twenty percent (20%) of the outer cover is comprised of the display-looped fabric.

5. A kit as claimed in claim 1 wherein the construction pieces are rectangular slabbed-shaped block elements having a side wall height preferably greater than 1.25 inches and preferably in the range of between 1.25 inches and 3 inches and length and width dimensions so that the product of the length and width is at least 81 square inches and not greater than 1440 square inches.

6. A kit as claimed in claim 1 wherein at least one of the construction pieces is a six-sided member and the product of the x, y, z dimensions are equal to or less than the range between 126 cubic inches and 2744 cubic inches.

7. A kit as claimed in claim 1 including a thin flexible plastic sheath completely surrounding the core and disposed between the core and the outer cover to facilitate easy removal and assembly of the core inside the cover.

8. A kit for building objects from block-like construction pieces comprising a plurality of construction pieces, each piece having a core made of resilient flexible foam material and having a plurality of planar faces, and outer cover snugly fitting over and completely covering the outer peripheral surface of the foam core made of a looped fabric and a plurality of double-sided hooked surface tabs for lockingly engaging with the loop fabric so that the construction pieces may be releasably assembled to one another and reinforcing strips adapted to be removably connected to tabs for bridging adjacent blocks.

9. A kit for building objects from block-like construction pieces comprising a plurality of construction pieces, each piece having a core made of resilient flexible foam material and having a plurality of planar faces, an outer cover snugly fitting over and completely covering the outer peripheral surface of the foam core made of a fabric having external loops covering at least a portion of each of the planar faces and a plurality of double-sided hooked surface tabs for lockingly engaging with the loop fabric so that the construction pieces may be releasably assembled to one another.

10. A kit for building objects from block-like construction pieces comprising a plurality of construction pieces, each piece having a core made of resilient flexible foam material and having a plurality of planar faces, an outer cover snugly fitting over and completely covering the outer peripheral surface to the foam core made of a looped fabric and a protective waterproof sheathing between the foam core and outer cover and a plurality of double-sided hooked surface tabs for lockingly engaging with the loop fabric so that the construction pieces may be releasably assembled to one another.

11. A kit for building objects from block-like construction pieces comprising a plurality of construction pieces, each piece having a core made of resilient flexible foam material and having a plurality of planar faces, loop fabric ends bonded directly to the core and completely covering the outer peripheral surface of the foam core and a plurality of double-sided hooked surface tabs for lockingly engaging with the loop fabric so that the construction pieces may be releasably assembled to one another.

12. A construction piece comprising:

a) a core made of resilient, flexible material;

b) said core having at least five planar faces;

c) an outer cover snugly fitting over and completely covering the outer peripheral surface of the core having loop fabric covering at least 20% of at least five faces; and d) a waterproof lining between the core and the outer cover having at least one opening to allow insertion of said core into the lining.

13. A construction piece as claimed in claim 12 wherein the pieces are rectangular slab-shaped blocks having a height designated by the letter X dimension greater than 1.25 inches and less than 3 inches and the length and width designated by the letters Z and Y respectively, are in the range of at least 81 square inches; and Y×Z dimensions are less than or equal to 1440 square inches.

14. A construction piece as claimed in claim 12 wherein the height dimension designated by the letter X is equal to or greater than 4 inches, the width dimension designated by the letter Y is equal to or greater than X, and the length dimension designated by the letter Z is equal to or less than 2X.

15. A construction pieces as claimed in claim 12, wherein the product of the height, width and length designated by the letters X×Y×Z is equal to or less than 2744 cubic inches, and the product of X×Y×Z is equal to or greater than 126 cubic inches.

16. A kit for building objects from block-like construction pieces comprising a plurality of construction pieces, each piece having a core made of resilient, flexible material and having a five planar faces, an outer cover snugly fitting over and completely covering the outer peripheral surface of the core having loop fabric covering at least 20% of each of the five faces, and a plurality of double-sided hooked surfaced tabs for lockingly engaging with the loop fabric so that the construction pieces may be releasably assembled to one another.

17. A kit for building objects from block-like construction pieces comprising a plurality of construction pieces, each piece having a core made of resilient, flexible material and having a five planar faces, an outer cover snugly fitting over and completely covering the outer peripheral surface of the core having loop fabric covering at least a portion of each of the five faces, and a plurality of double-sided hooked surfaced tabs for lockingly engaging with the loop fabric so that the construction pieces may be releasably assembled to one another.

18. A kit for building objects from block-like construction pieces comprising a plurality of construction pieces, each piece having a core made of resilient, flexible material and having at least six planar faces, an outer cover snugly fitting over and completely covering the outer peripheral surface of the core having loop fabric covering at least 20% of each of at least six faces, and a plurality of double-sided hooked surfaced tabs for lockingly engaging with the loop fabric so that the construction pieces may be releasably assembled to one another.

19. A kit for building objects from block-like construction pieces comprising a plurality of construction pieces, each piece having a core made of resilient, flexible material and having at least six planar faces, an outer cover snugly fitting over and completely covering the outer peripheral surface of the core having loop fabric covering at least a portion of each at least six faces, and a plurality of double-sided hooked surfaced tabs for lockingly engaging with the loop fabric so that the construction pieces may be releasably assembled to one another.

20. A kit for building objects from block-like construction pieces comprising a plurality of construction pieces, each piece having a core made of resilient flexible foam material and having a plurality of planar faces, an outer cover snugly fitting over and completely covering the outer peripheral surface of the foam core made at least in part of a looped fabric and a protective waterproof sheathing between the foam core and outer cover and a plurality of double-sided hooked surface tabs for lockingly engaging with the loop fabric so that the construction pieces may be releasably assembled to one another.

* * * * *